US006126265A

United States Patent [19]

Childers et al.

[11] Patent Number: 6,126,265

[45] **Date of Patent: *Oct. 3, 2000**

[54] INK JET PRINTER SERVICE STATION CONTROLLED BY DATA FROM CONSUMABLE PARTS WITH INCORPORATED MEMORY DEVICES

[75] Inventors: Winthrop D. Childers, San Diego, Calif.; Bloor Redding, Jr., Vancouver, Wash.; Donald L. Michael, Monmouth, Oreg.; Michael L. Bullock, San Diego, Calif.

[73] Assignee: Hewlett-Packard Company, Palo Alto, Calif.

[ * ] Notice: This patent is subject to a terminal disclaimer.

[21] Appl. No.: 08/895,163

[22] Filed: Jul. 16, 1997

Related U.S. Application Data

[63] Continuation-in-part of application No. 08/785,580, Jan. 21, 1997, Pat. No. 5,812,156.

[51] Int. Cl.[7] ..... B41J 2/165

[52] U.S. Cl. ..... 347/23; 347/29; 347/33; 347/86

[58] Field of Search ..... 347/23, 29–33, 347/86, 19

[56] References Cited

U.S. PATENT DOCUMENTS

| | | | |
|---|---|---|---|
| 4,551,000 | 11/1985 | Kanemitsu et al. | 355/3 R |
| 4,763,281 | 8/1988 | Arakawa | 347/5 |
| 4,803,521 | 2/1989 | Honda | 355/14 R |
| 4,961,088 | 10/1990 | Gilliland et al. | 355/206 |
| 5,016,171 | 5/1991 | Connolly et al. | 364/406 |
| 5,049,898 | 9/1991 | Arthur et al. . | |
| 5,137,379 | 8/1992 | Ukai et al. | 400/121 |
| 5,155,497 | 10/1992 | Martin et al. . | |
| 5,184,181 | 2/1993 | Kurando et al. | 355/260 |
| 5,272,503 | 12/1993 | LeSueur et al. | 355/208 |
| 5,283,613 | 2/1994 | Midgley, Sr. | 355/203 |
| 5,410,641 | 4/1995 | Wakabayashi et al. | 395/112 |
| 5,506,611 | 4/1996 | Ujita et al. | 387/86 |
| 5,579,039 | 11/1996 | Kurata et al. | 347/49 |
| 5,610,635 | 3/1997 | Murray et al. | 347/7 |
| 5,812,156 | 9/1998 | Bullock et al. | 347/19 |
| 5,886,715 | 3/1999 | Fukuoka | 347/33 |

FOREIGN PATENT DOCUMENTS

| | | | |
|---|---|---|---|
| 0608104 | 7/1994 | European Pat. Off. . | |
| 0720916A2 | 7/1996 | European Pat. Off. . | |
| 0 764 535 | 3/1997 | European Pat. Off. | B41J 2/165 |
| 00771660 | 5/1997 | European Pat. Off. . | |
| 00778140 | 6/1997 | European Pat. Off. . | |
| 0 812 693A1 | 12/1997 | European Pat. Off. . | |
| 00854044 | 7/1998 | European Pat. Off. . | |

OTHER PUBLICATIONS

Search Report for European Application No.: 98305587.2 Dated Jul. 28, 1999–Examiner: B. Didenot (3pages).

*Primary Examiner*—N. Le
*Assistant Examiner*—Shih-wen Hsieh

[57] ABSTRACT

An inkjet printing system includes a replaceable printhead having plural nozzles for ejecting ink droplets, a service station for capping and wiping the plural nozzles, and a replaceable ink cartridge housing a supply of ink and further including a cartridge memory for recording service station-control data. A processor is coupled to the ink cartridge memory and is responsive to service station-control data read from the cartridge memory to derive a service station control value. The printhead further includes a memory which records printhead-related parameters, and the processor is responsive thereto and service station-control data read from said cartridge memory to control the service station. The control data may be service station parameters, one or more subroutines to control the service station and combinations thereof.

27 Claims, 4 Drawing Sheets

INK JET PRINTER SERVICE STATION CONTROLLED BY DATA FROM CONSUMABLE PARTS WITH INCORPORATED MEMORY DEVICES

This application is a continuation-in-part of U.S. patent application, Ser. No. 08/785,580, filed Jan. 21, 1997 now U.S. Pat. No. 5,812,156.

FIELD OF THE INVENTION

This invention relates to inkjet printer systems that employ replaceable, consumable parts and, more particularly, to an inkjet printer which include includes a service station whose operation is controlled by parameters stored on memories that are integral to the consumable parts.

BACKGROUND OF THE INVENTION

Substantially, all present-day copiers, printers, plotters, etc., include a controlling microprocessor which requires input control parameters to assure high quality production of documents. Since most such apparatus allows user-replacement of consumable items, various techniques have been developed to enable entry of such parameters.

In regards to inkjet printers, it has been proposed that print heads incorporate a parameter memory for storage of operating parameters such as: drop generator driver frequency, ink pressure and drop charging values (see "Storage of Operating Parameters in Memory Integral with Print Head", Lonis, Xerox Disclosure Journal, Volume 8, No. 6, November/December 1983, page 503). U.S. Pat. No. 5,138,344 to Ujita, entitled "Inkjet Apparatus and Inkjet Cartridge Therefor", indicates that an ink-containing replaceable cartridge can be provided with an integral information device (i.e., a resistor element, magnetic medium, bar code, integrated circuit or ROM), for storage of information relating to control parameters for the inkjet printer. Murray et al. in U.S. Pat. No. 5,610,635, describe a printer ink cartridge which includes a memory for storing various parameters related to ink contained within the cartridge.

U.S. Pat. No. 5,365,312 to Hillmann et al., entitled "Arrangement for Printer Equipment Monitoring Reservoirs that Contain Printing Medium", describes the use of memory devices integral with ink reservoirs which store ink consumption data (for use by a coupled inkjet printer). European patent EP 0 720 916, entitled "Ink Supply Identification System for a Printer" describes the use of an ink supply having an integral EEPROM which is utilized to store data regarding the identity of the ink supply and its fill level.

The prior art further teaches the use of consumable parts with integral memory for use in electrophotographic printers. In U.S. Pat. No. 5,021,828 to Yamaguchi et al., entitled "Copying Apparatus having a Consumable Part", a toner cartridge is disclosed which includes a memory for storing data regarding to the state of consumption of toner in the cartridge. U.S. Pat. No. 4,961,088 to Gilliland et al.; U.S. Pat. No. 4,803,521 to Honda; U.S. Pat. No. 5,184,181 to Kurando et al.; and U.S. Pat. No. 5,272,503 to LeSueur et al. all describe various replaceable toner cartridges for use in electrophotographic printers. Each cartridge incorporates a memory device for storing parameter data regarding the cartridge.

Current inkjet printers mount inkjet printheads on a scanning carriage which is scanned across a media sheet, as the sheet is fed by the printer's sheet feed apparatus. At one extreme of the scan path is positioned a mechanism for maintaining the printhead in good working order. That mechanism is called a "service station" and is provided with both (i) rubber caps that protect the printhead's nozzles and nozzle plate during periods of non-use and (ii) a wiping mechanism for removing accumulated crust which builds up on the nozzle plate over time.

Two problems confront most printheads, i.e., ink plugs and ink crust. An ink plug is an accumulated amount of dried ink which plugs a nozzle and inhibits drop ejection. The dried ink builds up during non-firing time in both the capped and uncapped states, but more slowly in the capped state. Ink crust on the nozzle plate builds up during printing and is a layer of dried ink which accumulates as a result of an ink aerosol that settles thereon.

Ink plugs can be ejected by firing a nozzle (i.e., "spitting") into a spittoon that is typically positioned adjacent to the service station. The nozzle is repeatedly fired until the effect of the plug is eliminated. The number of firings required to dislodge an ink plug is determined by whether the printhead has been capped or uncapped; the total time since the last firing; ambient humidity and temperature; and the type of ink. As inks become faster drying and more permanent, the number of firings needed to clear a nozzle increases.

"Pulsewarming" is one way to reduce the required number of firings to clear a nozzle. Most inkjet printheads employ heater resistors to cause ejection of an ink droplet through a nozzle. Pulsewarming is the application of a low level of current to the heater resistors which is insufficient to cause ink ejection, but is sufficient to warm the ink substrate and hence the ink. The heated ink acts as a better solvent in removing ink plugs.

In the prior art, the printer firmware included parameters which controlled the number of "spits" of ink that were used to dislodge an ink plug and the current level required to achieve pulsewarming. However, because ink chemistries and printer designs are continually evolving, it is difficult to establish optimal spitting and pulsewarming criteria at the time of introduction of a printer to the marketplace. In other words, the aforesaid parameters are "moving targets"—even after a printer model is introduced.

Ink crust is normally removed by wiping the nozzle plate at the service station. With new, more permanent and fast drying inks, it has been found that more effective wiping is accomplished when a solvent (e.g., polyethylene glycol) is placed on the absorbent material that is used as the wiper. In addition, the order of spitting, wiping and cleaning can be important to the proper maintenance of the printhead.

Clearly there are a number of factors which should be considered when undertaking to control an inkjet printer's service station to assure long printhead lifetime. Among the factors are those which are directly related to the removal of ink plugs and the wiping action. Since many of those factors are variable during the lifetime of a printer, the prior art has used conservative, compromise servicing routines to achieve a best case operation. However, such compromises do not lead to best quality print documents. Also, such compromise service routines can take more time than necessary, slowing down printing operations.

Accordingly, it is an object of this invention to provide a print apparatus with an improved capability for adjustment of printer control functions.

It is another object of this invention to provide an improved printer control system which is able to update control parameters for a service station that are dependent upon current printer performance parameters.

It is yet another object of this invention to provide improved service station operation for an inkjet printer, wherein control parameters for the service station are read from plural consumable parts.

It is still another object of this invention to be able to alter the servicing routine of the printer based on new software routines contained in plural consumable parts.

SUMMARY OF THE INVENTION

An inkjet printing system includes a replaceable printhead having plural nozzles for ejecting ink droplets, a service station for capping and wiping the plural nozzles, and a replaceable ink cartridge housing a supply of ink and further including a cartridge memory for recording service station-control data. A processor is coupled to the ink cartridge memory and is responsive to service station-control data read from the cartridge memory to derive a service station control value. The printhead further includes a memory which records printhead-related parameters, and the processor is responsive thereto and service station-control data read from said cartridge memory to control the service station. The control data may be service station parameters, one or more subroutines to control the service station and combinations thereof.

DETAILED DESCRIPTION OF THE INVENTION

Figure 1:
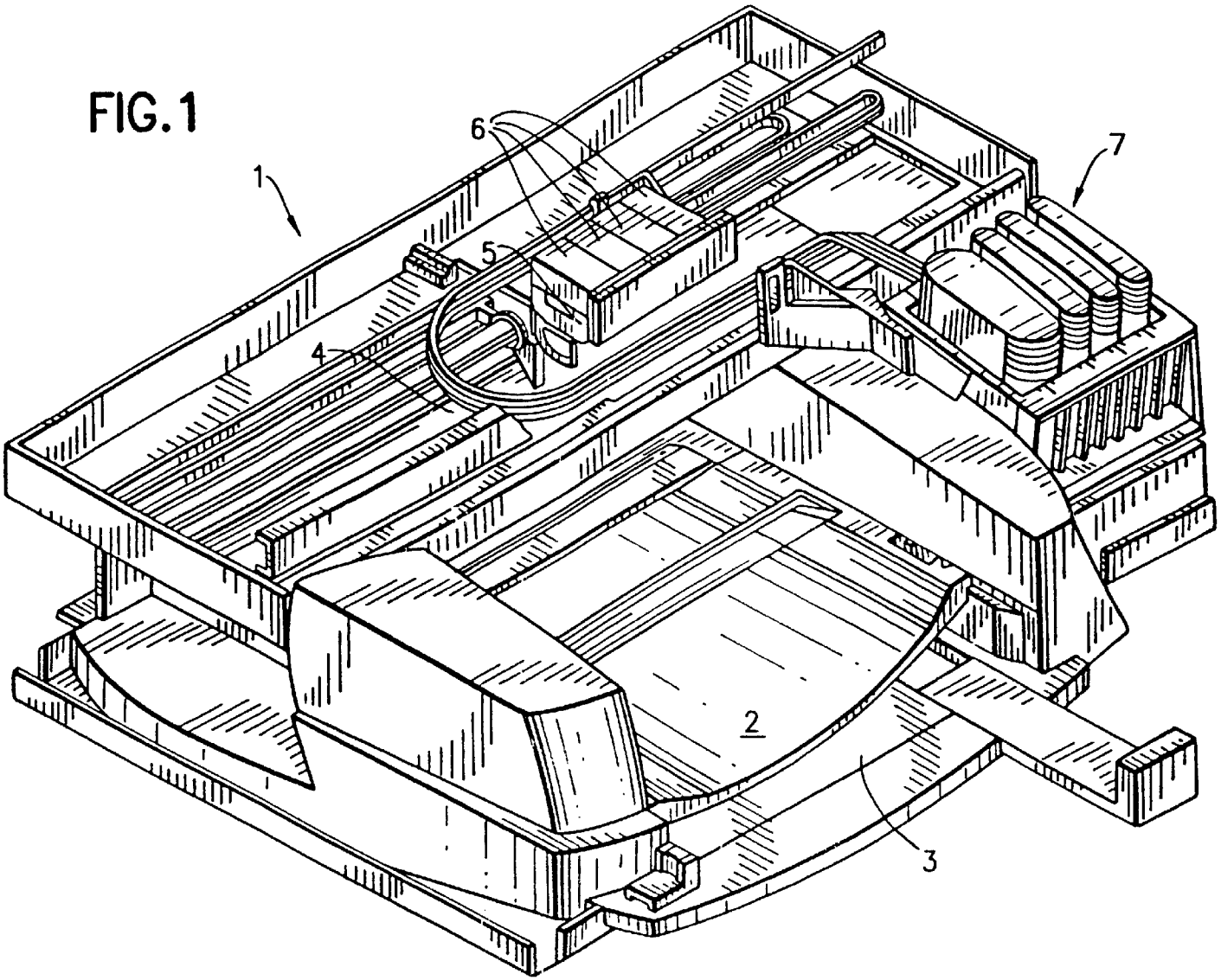
FIG. 1 is perspective view of an inkjet printer (with cover removed), which incorporates the invention.
Figure 1A:
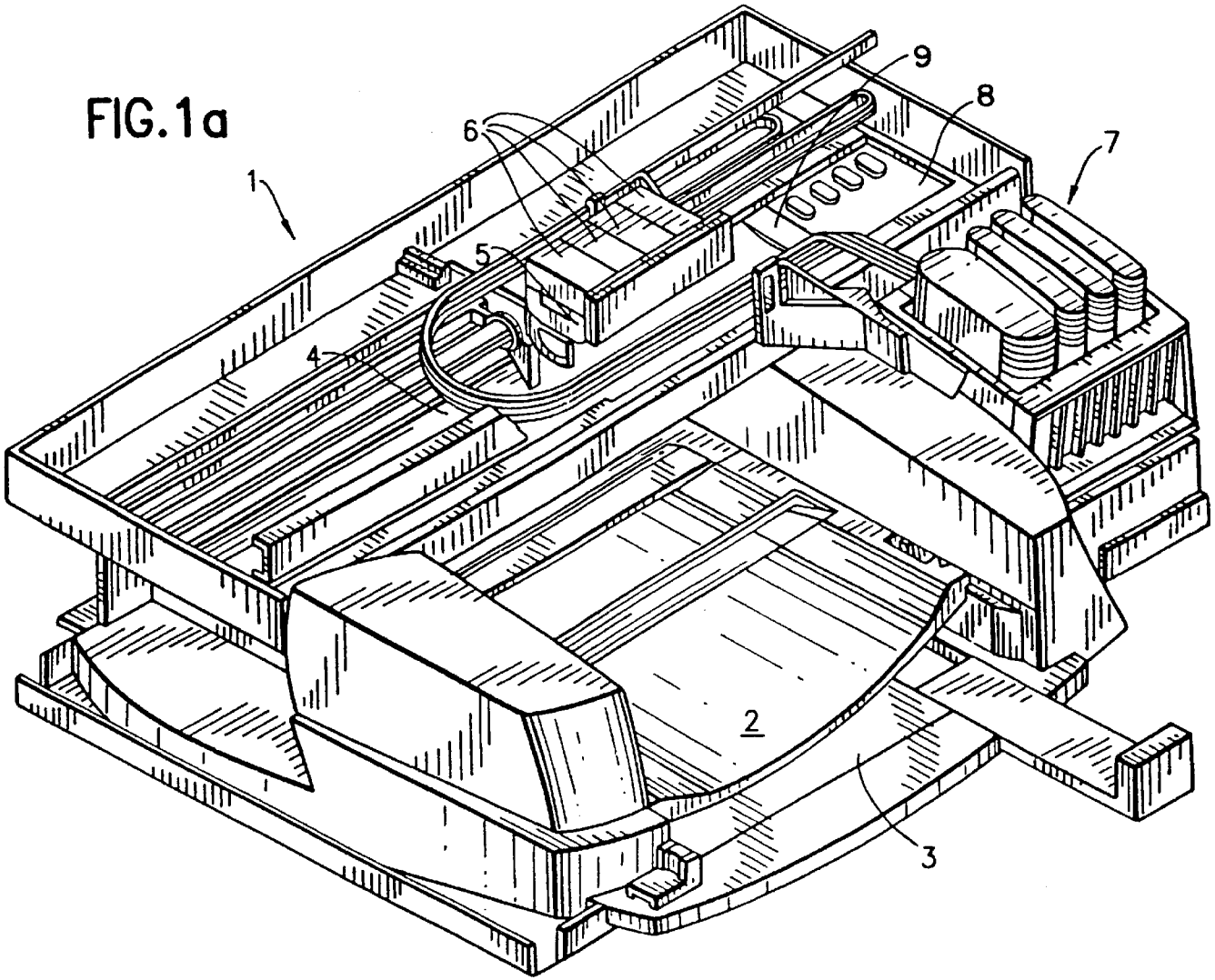
FIG. 1*a* is a perspective view of an inkjet printer (with cover removed), which incorporates the invention.

FIG. 1*a* illustrates a perspective view of an inkjet printer 1 incorporating the invention. A tray 2 holds a supply of input paper or other print media. When a printing operation is initiated, a sheet of paper is fed into printer 1 and is then brought around in a U direction towards an output tray 3. The sheet is stopped in a print zone 4 and a scanning carriage 5, containing plural, removable color printheads 6, is scanned across the sheet for printing a swath of ink thereon. The process repeats until the entire sheet has been printed, at which point, it is ejected onto output tray 3.

Printheads 6 are, respectively, fluidically coupled to four removable ink cartridges 7 holding Cyan, Magenta, Yellow and Black inks. Since black ink tends to be depleted most rapidly, the black ink cartridge has a larger capacity than the other cartridges. As will be understood from the description which follows, each printhead and ink cartridge is provided with an integral memory device which stores data that is used by printer 1 to control its printing operations.

A printhead service station 8 and a spittoon 9 (shown schematically) are positioned to the right extremity of the printhead scan path. Service station 8 includes a mechanism for wiping the nozzle plate of the printheads as they are moved by the carriage into and out of a parked position at service station 8. Service station 8 also includes a mechanism for capping the nozzle plates when the printheads are in the parked position. As the invention hereof is not dependent upon the specific structure of service station 8, further detailed discussion thereof is not required. U.S. Pat. No. 5,155,497 to Martin et al. (assigned to the same Assignee as this Application) describes the structure and operation of a service station usable with the invention hereof, and its disclosure is incorporated herein by reference.

Figure 1B:
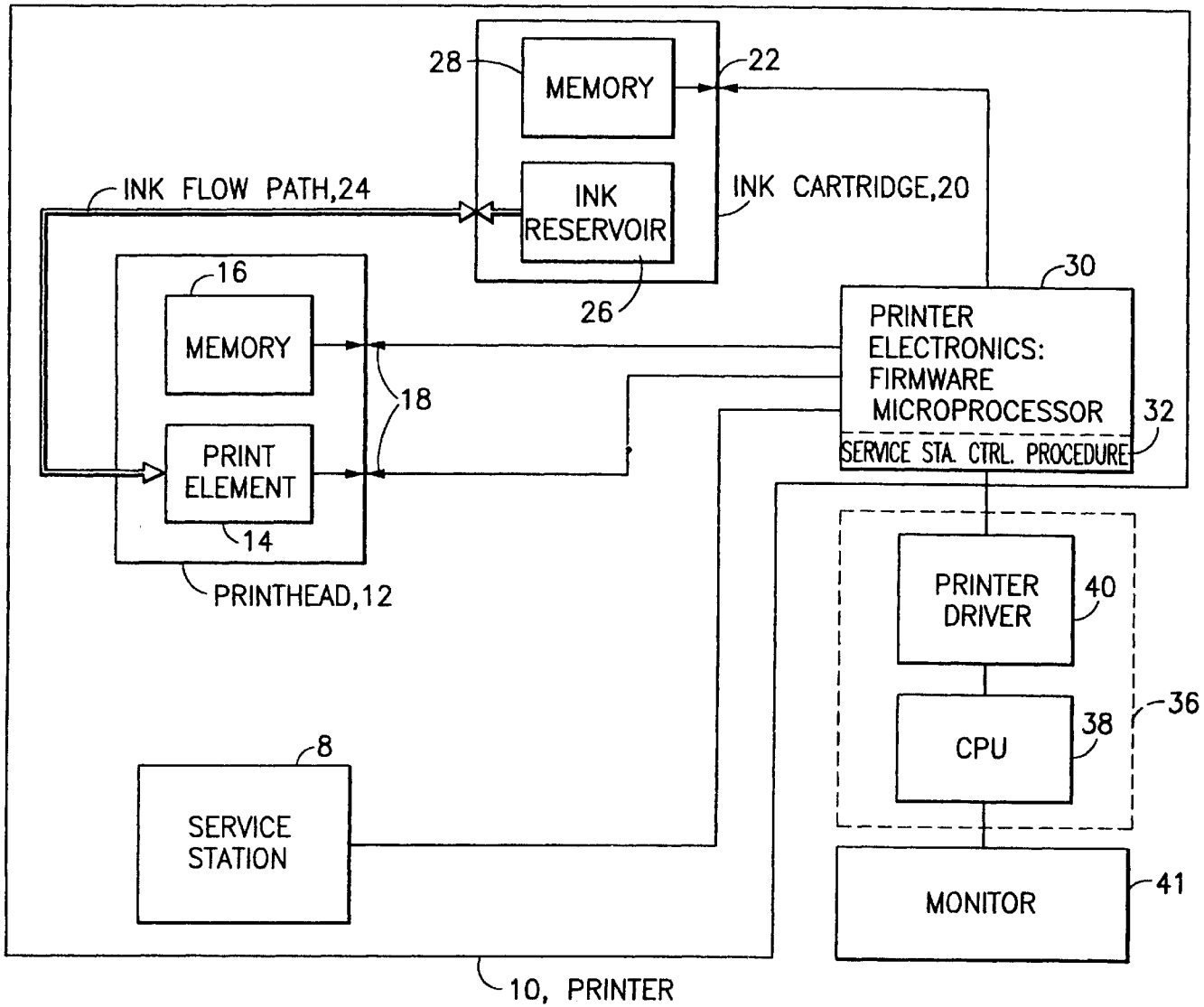
FIG. 1*b* is a block diagram of components of the inkjet printer of FIG 1*a*.

FIG. 1*b* illustrates pluggable printhead 12 which includes a print element 14 and an integrally mounted printhead memory 16. Printhead 12 is pluggably removable from printer 1 via interconnects 18. An ink cartridge 20 is also pluggably removable from printer 1 via electrical interconnect 22 and fluidic interconnect 24. Ink cartridge 20 includes an ink reservoir 26 and an integral cartridge memory 28. Service station 8 is also present in printer 1, as described above. The contents of memories 16 and 28 will be considered in detail below and, as will be understood, are instrumental in enabling real time control of service station 8.

Ink cartridge 20, printhead 12 and service station 8 are interconnected to a microprocessor 30 which includes both electronics and firmware for the control of the various printer sub-assemblies. A service station control procedure is executed by printing system 1 at various times during printing for the purpose of maintaining print quality. This control procedure can be incorporated in the driver, in the printer firmware, and/or in information storage devices 16 and 28. According to one aspect of the invention, storage devices 16 and 28 provide control parameters for service station operation. In a preferred mode, information storage devices 16 and 28 provide parts of or all of the entire service station control procedure. Generally, control data may be broken into two groups. The first group controls when and how much servicing occurs. The second group controls how the servicing is performed, including the order of wiping, spitting and cleaning. Either group may be altered of enhanced as described herein. Further, information storage devices can include date codes or revision numbers associated with parameters and/or control procedures to assure that a most recent version of the service station control procedure is used.

A host processor 36 is connected to microprocessor 30 and includes a central processing unit (CPU) 38 and a software printer driver 40. A monitor 41 is connected to host processor 36 and is used to display various messages that are indicative of the state of inkjet printer 1.

Figure 2:
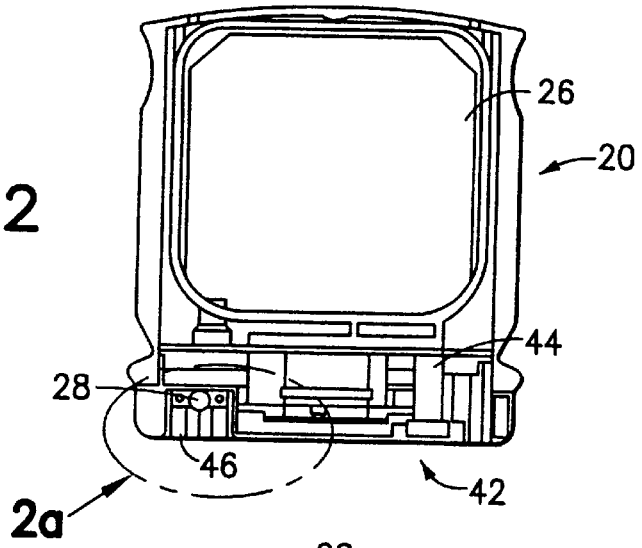
FIG. 2 is a schematic sectional view of a replaceable ink cartridge used with the inkjet printer of FIGS. 1*a* and 1*b*.

FIG. 2 illustrates a sectional view of ink cartridge 20. Ink cartridge 20 is pluggable into a receptacle (not shown) in inkjet printer 1 and includes both a fluidic interconnection and an electrical interconnection, both of which are accessible through bottom surface 42 via fluidic connector 44 and an electrical connector 46. Electrical connector 46 enables interconnection to a cartridge memory chip 28.

Figure 2A:
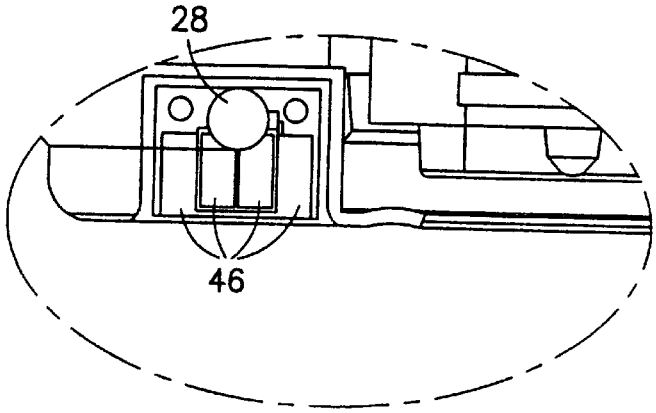
FIG. 2*a* is an expanded view of FIG. 2, showing details of a cartridge memory installed on the ink cartridge.

An expanded view of connector 46 and memory chip 28 is shown in FIG. 2*a*, with connector 46 making contact to a mating connector in the receptacle within inkjet printer 1 when inkjet cartridge 20 is pluggably inserted thereinto.

Figure 3:
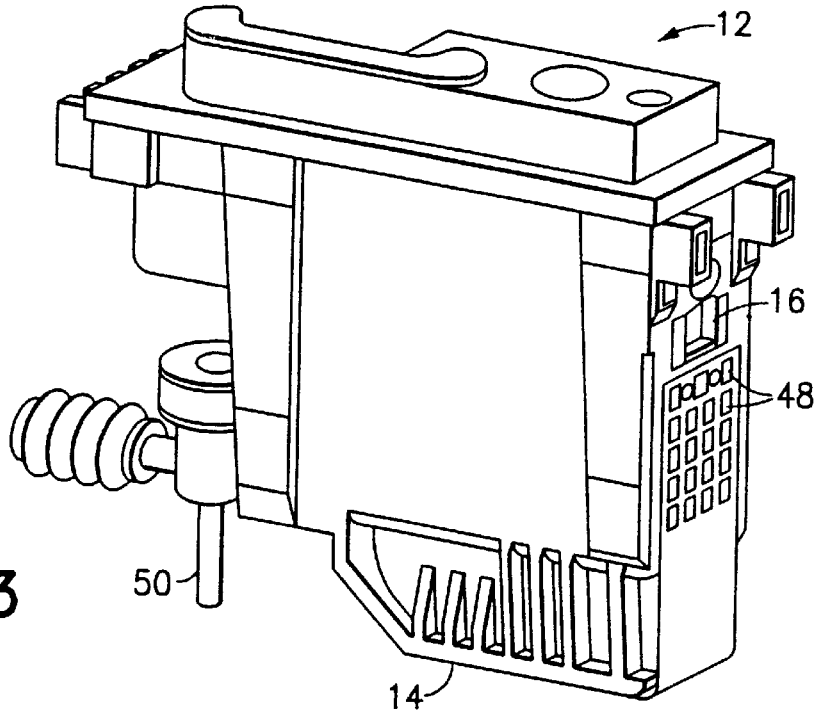
FIG. 3 is a perspective view of an inkjet printhead employed with the invention hereof.

FIG. 3 is a perspective view of printhead 12 and illustrates the placement of printhead memory 16 thereon. A plurality of contacts 48 enables pluggable connection to printhead memory 16 as well as various electrical elements within printhead 12. Printhead 12 is a known, thermally-actuated inkjet printhead, with a print element (including a nozzle plate) positioned at surface 14. Behind each nozzle is an ink chamber with a heater resistor. A thermal sense resistor is positioned on the printhead and detects the temperature of the semiconductor substrate on which the heater resistors are positioned. A fluidic interconnect 50 connects ink cartridge 12, via ink flow path 24 (see FIG. 1), to ink reservoir 26 in ink cartridge 20.

When printhead 12 is plugged into a receptacle (not shown) within inkjet printer 1, contacts 48 make electrical connection to a mating connector in the printer and fluidic interconnect 50 automatically mates to ink flow path 24 to enable a flow of ink thereto.

As indicated above, parameters and/or encoded subroutines stored in cartridge memory 28 and printhead memory 16 enable microprocessor 34 to calculate control values for service station 8. To accomplish control of service station 8, each of memories 16 and 28 includes both factory-written data and printer-recorded data. Many parameters present in the memories are not directly relevant to this invention and will not be considered herein. The following is a list of parameters relevant to control of service station 8 that are stored within the aforesaid memories:

Ink Cartridge Memory 16

Factory-written data:

1.—number of spits versus time uncapped (=slope);
2.—number of spits versus time capped (=slope);
3.—maximum number of spits;
4.—time frequency of wiping;
5.—number of pages printed between wipes;
6.—number of drops fired between wipes;
7.—number of wipes for each cleaning;
8.—number of wipes before wiper is rewetted with solvent;
9.—amount of time before wiper is rewetted with solvent; and
10.—frequency of flushing of the printhead (i.e., placing a vacuum on the nozzles to withdraw contaminents, bubbless and/or ink).

Printhead Memory 28

Printer-recorded data:

1.—number of drops fired;
2.—number of pages printed.

As will be hereafter understood, service station control procedure 32 makes use of the above-indicated parameters to control the operation of service station 8. In a number of instances, data from both memories 16 and 28 are utilized to arrive at an improved service station control value. Further, the ability to periodically replace memories 16 and 28, as their host carriers (e.g., printhead 12 or ink cartridge 20) are replaced, enables the manufacturer to provide updated parameters, on a continuing basis, to customers who already have installed printers.

Service station control procedure 32 includes both a spitting algorithm and a wiping control algorithm. The spitting algorithm is used during an uncapped state (during or after printing) and just after a capped state(just before printing). The spitting algorithm receives signals from microprocessor 30 which enable it to determine the uncapped time of printhead 12. In accordance with the uncapped time indication, service station control procedure 32 accesses values which define the relationship between a number of spits versus time uncapped. In accordance with the determined number of spits, signals are sent to the printing system to position printhead 12 in facing relation with spittoon 19 and to cause the required number of spits to occur through the nozzle(s). When a printhead job is initiated after the printhead has been resting in a capped state, a similar process is used to provide the correct amount of spitting so that the nozzles will properly eject ink.

As regards the wiping algorithm, printhead 12 is incremented to its park position to enable the wiping procedure to occur. If the procedure senses that a time period since a last wipe action has passed which exceeds the "time frequency of wiping" threshold (parameter 4 above), then a wiping action is ordered. If the time frequency of wiping threshold is not reached, but the number of pages printed between wipes reaches the threshold value given by parameter 5 above, then a wipe action is ordered. Note that the number of pages printed value is acquired from memory 16 on printhead 12—to accommodate the possibility that printhead 12 may have been moved from one printer to another.

The number of wipes for each cleaning is determined by a wipe parameter, which defines the number of wipes that are performed on the nozzle plate to accomplish a desired level of cleaning. Clearly this parameter, and others will vary in accordance with the specific ink that is present in ink cartridge 20. Accordingly, those values are modified if a new ink type requires such a modification. The remaining parameters are self-evident and are utilized by the procedure to further control the wiping action.

In lieu of recording all of the service station parameters, on the memory element, the encoding thereof may take other forms. The printer driver or printer firmware may include a plurality of service station control procedures, each such procedure associated with an address. The selected address may then be a value which is encoded on memory 28 on each cartridge 20. Thus when the address is accessed from memory 28, it enables the retrieval of the desired service station control procedure. Further, some combination of driver-contained parameters and ink cartridge-contained parameters may be utilized.

As an example, a new printer may be introduced with a first type of ink. If, after introduction, a second type of ink is discovered that drys faster and is otherwise fully compatible with the first ink, a new print cartridge would be introduced containing the new and faster-drying ink. By encoding the wiping and spitting parameters on the new ink cartridge, such parameters can be utilized by the printer without any requirement being placed upon the user to update the printer software. The memory can also contain software objects, for example, JAVA objects which could contain service station parameters, routines or both.

This invention may be extended to not only optimize individual servicing parameters for a given service station routine—but also to optimize an entire service station routine. Printhead servicing is typically done before, during, and after printing as well as in response to a user prompt. After market introduction of a printer, it may be desirable to change the entire servicing routine, including the order of servicing operations. To accomplish this, an entire subroutine may be encoded on ink container memory element 28. During certain events or after certain time periods or amounts of usage, such a service subroutine (or subroutines) are accessed by the printing system. At such time, the subroutine from the ink container effectively takes control of printer maintenance.

The following is a specific example of a series of events which occur when a print job is sent to the printer:

1. Print job started (by the user);
2. Printer reads a preprint service subroutine #1 and a parameter set from ink cartridge memory 28;
3. Printer executes preprint subroutine #1 prior to printing;
4. Printer prints the print job, using parameters from the parameter set;
5. Printer executes postprint service subroutine #2 after printing.

Subroutines #1 and #2 are generally as follows:

Subroutine #1;

1) Label or tag (a set of bits that dictate that this is a service routine to be performed at the beginning of a print job.
2) Spit command (set of bits that tell the printer to carry out a spit action).
3) Spit parameters (set of bits that indicate a number of spits in accord with the time the printhead was in a capped position).
4) End (set of bits that signal the printing system that the end of the routine has been reached)

Subroutine #2:

1) Label
2) Wipe command
3) Wipe parameters
4) Spit command
5) Spit parameters
6) End of subroutine.

By providing both parameters and subroutines encoded on ink cartridge memory 28, substantial flexibility is achieved to adjust such parameters or subroutines after a user purchases a printer. For instance, over time it may be determined that Subroutine #1 is more effective if a wipe command is executed prior to the spit command. It may also be determined that the spit command is not necessary for Subroutine #2, or that the order of the spit and wipe operations should be changed. Parameters may be variable (dependent on time, amount of printing, etc.) or fixed (a set number of spits). The commands can also be subroutine calls themselves directing the sequence and control of the servicing process. The subroutines called may be located in the driver or in the printer firmware. Alternatively, an object oriented language can be used. New objects could be contained in memories 16 or 28. Duplicate names would be resolved at runtime by deferring to the object in the cartridge first, printhead second and finally the printer. This offers the advantage of using minimum memory when supplying new control information. Similarly, latest date codes or revision numbers would enjoy priority.

It should be understood that the foregoing description is only illustrative of the invention. Various alternatives and modifications can be devised by those skilled in the art without departing from the invention. While the above invention has been described in the context of an inkjet printer, those skilled in the art will realize that it is equally applicable to other printer/copier arrangements which employ inkjet print mechanisms and replaceable units therefor and wherein service station control procedures are programmable. Further, this invention can be used when the printhead and ink cartridge are one integrated, replaceable unit or when they are separately replaceable. Accordingly, the present invention is intended to embrace all such alternatives, modifications and variances which fall within the scope of the claims.

What is claimed is:

1. An inkjet printing system comprising:

a printhead having nozzles for ejecting ink droplets;

a service station for capping and wiping said plural nozzles;

replaceable cartridge means for housing a supply of consumable marking media and including cartridge memory means for recording service station-control data; and processor means, including processor memory, coupled to said cartridge memory means and responsive to said service station-control data read from said cartridge memory means for operating said service station.

2. The inkjet printing system as recited in claim 1, wherein said printhead is replaceable, said inkjet printing system further comprising:

printhead memory means positioned on said printhead, for recording printhead-related parameters;

said processor means further responsive to a printhead-related parameter read from said printhead memory means and service station-control data read from said cartridge memory means to control said service station.

3. The printing system as recited in claim 2, wherein said service station-control data read from said cartridge memory means is given priority over control data from the printhead and control data from the printhead is given priority over control data stored in the printer.

4. The printing system as recited in claim 2, wherein said replaceable cartridge is separately replaceable from said printhead.

5. The printing system as recited in claim 2, wherein said replaceable cartridge is integral with said printhead.

6. The printing system as recited in claim 2, wherein said service station-control data read from said cartridge memory means which includes a date code is given priority over control data having an earlier date code.

7. The inkjet printing system as recited in claim 1, wherein said replaceable cartridge means is an ink reservoir cartridge that is pluggably insertable into said printing system, said cartridge memory means forming an integral part of said cartridge means and making electrical connection to said printing system upon insertion of said cartridge means.

8. The printing system as recited in claim 1, wherein said data read from said cartridge memory means further includes a value from which said processor means derives a number of ink ejections for clearing a blocked nozzle.

9. The printing system as recited in claim 1, wherein said service station-control data read from said cartridge memory means includes a value which is used by said control means to enable processor of a number of wipes applied by said service station to said printhead.

10. The printing system as recited in claim 1, wherein said service station-control data read from said cartridge memory means includes a subroutine for enabling said processor means to operate said service station.

11. The printing system as recited in claim 1, wherein said service station-control data read from said cartridge memory means includes plural parameters used by said processor means to operate said service station.

12. The printing system as recited in claim 1, wherein said service station-control data read from said cartridge memory means includes at least one parameter used by said processor means to access a service station control procedure from said processor memory.

13. A method for controlling operation of an inkjet printing system, wherein the inkjet printing system includes (i) a service station for capping and wiping a nozzle plate present on a printhead, (ii) a replaceable cartridge for housing a supply of consumable marking media, said replaceable cartridge further including a cartridge memory for recording printhead servicing data, and (iii) a printhead for producing marks on a print media, said printhead including a nozzle plate, the method comprising the steps of:

a) reading printhead servicing data stored on at least said cartridge memory;

b) deriving a service station function control value that is dependent upon said printhead servicing data read from said cartridge memory; and c) controlling said service station in accord with said service station function control value.

14. The method as recited in claim 13, wherein step a) further reads a printhead-related parameter from a printhead memory means, and step b) employs said printhead-related parameter and said printhead servicing data read from said cartridge memory to control said service station.

15. The method as recited in claim 13, wherein said printhead servicing data read from said cartridge memory means includes a value from which step b) derives a control signal for causing said printhead to generate a number of ink ejections to clear one or more blocked nozzles.

16. The method as recited in claim 13, wherein said printhead servicing data read from said cartridge memory means includes a value from which step b) derives a signal to control a number of wipes applied by said service station to said printhead.

17. The method as recited in claim 13, wherein said printhead servicing data read from said cartridge memory means includes a subroutine for enabling said processor to operate said service station.

18. The method as recited in claim 13, wherein said printhead servicing data read from said cartridge memory means includes plural parameters used by said processor means to operate said service station.

19. The method as recited in claim 13, wherein step c) wherein said printhead servicing data includes at least one parameter that is used by said printer system to access a service station control procedure from a memory.

20. A replaceable ink cartridge for an inkjet printing system, the printing system including a printhead for producing marks on a print media, the printing system further including a printhead service station for performing capping and wiping functions for said printhead, and a processor with processor memory, the replaceable ink cartridge comprising:

an ink reservoir containing an ink supply;

a cartridge memory element having service station-control data stored thereon, the cartridge memory element electrically coupled with the processor means so that the processor means has access to the service station-control data when the ink cartridge is installed in a receptacle in said printing system; and wherein, in order to carry out a service station operation, service station-control data stored in the cartridge memory element are read by said processor to enable said processor to derive a service station control value.

21. The replaceable ink cartridge of claim 20, wherein the cartridge-control data includes factory-installed parameters that are recorded at the time the ink cartridge is manufactured.

22. The replaceable ink cartridge of claim 21, wherein the cartridge factory parameters include a value from which said processor derives a number of ink ejections required to clear a blocked nozzle, based upon a period of time the nozzles have gone without firing in a capped or uncapped state.

23. The replaceable ink cartridge of claim 21, wherein the cartridge factory parameters include a value which is used by said processor to control a number of wipes applied by said service station to said printhead.

24. The replaceable ink cartridge of claim 20, wherein the cartridge-control data includes a subroutine for enabling said processor to operate said service station.

25. The replaceable ink cartridge of claim 20, wherein the cartridge-control data includes a software object for enabling said processor to operate said service station.

26. The replaceable ink cartridge of claim 25, wherein the cartridge-control data replaces an existing software object which is located in one of said printhead memory unit and processor memory.

27. The replaceable ink cartridge of claim 20, wherein said said ink reservoir is integral with said printhead, both said printhead and ink cartridge being user-replaceable.

* * * * *

UNITED STATES PATENT AND TRADEMARK OFFICE

CERTIFICATE OF CORRECTION

PATENT NO. : 6,126,265
DATED : October 3, 2000
INVENTOR(S) : Childers et al.

It is certified that error appears in the above-identified patent and that said Letters Patent is hereby corrected as shown below:

In the References Cited section of the title page of the patent, insert --WO97/23352--.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*